US007488263B2

(12) United States Patent
Lee

(10) Patent No.: US 7,488,263 B2
(45) Date of Patent: Feb. 10, 2009

(54) GOLF TEE SET

(75) Inventor: Lien-Hsin Lee, Luchou (TW)

(73) Assignee: Moldetk Precision Corp., Taipei Hsien (TW)

( * ) Notice: Subject to any disclaimer, the term of this patent is extended or adjusted under 35 U.S.C. 154(b) by 111 days.

(21) Appl. No.: 11/625,803

(22) Filed: Jan. 22, 2007

(65) Prior Publication Data

US 2008/0039238 A1 Feb. 14, 2008

(30) Foreign Application Priority Data

Aug. 11, 2006 (TW) ..... 95129692 A

(51) Int. Cl.
*A63B 57/00* (2006.01)

(52) U.S. Cl. ..... 473/394; 473/393

(58) Field of Classification Search ..... 473/387, 473/393, 394, 396, 397, 398, 400, 401, 402
See application file for complete search history.

(56) References Cited

U.S. PATENT DOCUMENTS 1,551,003 A * 8/1925 Bennion ..... 473/394
1,638,448 A * 8/1927 Manson ..... 473/394
1,655,751 A * 1/1928 Cody ..... 473/391
1,670,123 A * 5/1928 Ranseen ..... 473/396
1,678,944 A * 7/1928 Jacobsen ..... 473/396
1,736,583 A * 11/1929 Deike ..... 473/396
2,159,893 A * 5/1939 Hansen ..... 473/393
3,516,664 A * 6/1970 Brennan ..... 473/278
4,114,878 A * 9/1978 Hammond ..... 473/394
D370,041 S * 5/1996 Thomas ..... D21/718
6,729,977 B1 * 5/2004 Young et al. ..... 473/398
2006/0100037 A1 * 5/2006 Pels ..... 473/387
2006/0199669 A1 * 9/2006 Barouh ..... 473/398
2008/0064532 A1 * 3/2008 Lee ..... 473/396

* cited by examiner

*Primary Examiner*—Steven Wong
(74) *Attorney, Agent, or Firm*—Bacon & Thomas, PLLC

(57) ABSTRACT

A golf tee set is disclosed to include a tee, which a top has three raised portions equiangularly spaced around a recess for supporting a golf ball for hitting, a disc member positioning the tee on the ground at the desired elevation so that the golfer can strike the golf ball long and straight, a first fastening member and a second fastening member respectively provided at the tee and the disc member to secure the tee to the disc member at the desired elevation, a cord member inserted through one wire hole of the disc member and secured thereto to carry a magnetic member, and a metal anchoring member for positioning on the ground to secure the magnetic member in place by magnetic attraction.

16 Claims, 7 Drawing Sheets

GOLF TEE SET

This application claims the priority benefit of Taiwan patent application number 095129692 filed on Aug. 11, 2006.

BACKGROUND OF THE INVENTION

1. Field of the Invention

The present invention relates to a golf tee to be used in playing golf. Particularly a golf tee set, which comprises a tee with concave top to support a golf ball, a shaft member to the tee top, and an adjustable disc to position the tee top at the desired elevation for various golf clubs and field conditions.

2. Description of the Related Art

Nowadays, golf has become one kind of sports to many people for recreational purpose as well as the purpose of exercise. When hitting a golf ball at the tee box, a golf tee is used to support the golf ball off the ground. The game of golf involves many factors, such as the golfer's size and physical conditions, the type and quality of the golf club used, swing habit in striking, etc. A good swing enables the golfer to hit the golf ball at the spot. Either an iron club or wooden club is used, the elevation of the golf tee has a great influence on the golfer's performance. If the golf tee is not set at a suitable elevation, it is difficult for the golfer to hit the right part of the golf ball accurately. However, when inserting a golf tee to the ground, the golfer cannot precisely control the insertion depth of the golf tee in the ground, and the elevation of the golf tee may be measured roughly by feeling. In this case, the golfer may be unstable to hit the right part of the golf ball, resulting in a wrong flying direction or distance of the golf ball and a lower performance.

Further, when practicing golf, the golfer may check one's posture and the motion of the golf ball to evaluate the performance. Conventionally, an experienced golfer will check the fallen position of the golf tee to evaluate the direction of rotation of the golf ball and the striking performance after hitting the golf ball. However, the auto-return golf tee does not provide this function. Further, different golf tees of different heights may be used at different locations in a golf course. Therefore, when playing the game of golf, many golf tees are used, thereby increasing the playing cost.

Therefore, detachable golf tees are developed. A detachable golf tee is formed of an anchor and a receptacle. After hit the golf ball, the golfer can check the fallen position of the receptacle and judge the direction of rotation of the golf ball subject to the fallen position of the receptacle. In case the golfer hits the bottom side of the gravity center of the golf ball, the striking force of the golf club will force the receptacle to fall to the front side, and the golf ball will roll backwards. In case the golfer hits the top side of the gravity center of the golf ball, the striking force of the golf club will force the golf ball to rotate in counter-clockwise direction. Subject to the fallen position of the receptacle, the golfer can judge the striking performance. However, when the receptacle is struck away, the golfer may have to spend some time to find the displaced receptacle.

Further, conventional golf tees simply have a top recess for supporting a golf ball for hitting. When a golf ball is set in the top recess of a golf tee, the broad surface contact between the golf ball and the golf tee will produce a higher friction when the golfer hits the golf ball, resulting in a high rotation rate and short flying distance of the golf ball Therefore, it is desirable to provide a golf tee set that reduces the aforesaid drawbacks.

SUMMARY OF THE INVENTION

The present invention has been accomplished under the circumstances in view. According to one aspect of the present invention, the golf tee set comprises a top for supporting a golf ball, tee shaft with marked with both Metrics and Imperials length systems for measuring the height of tee above ground, a disc member mounted on the tee controlling the tee penetration into the ground, a first fastening member provided at the tee, and a second fastening member provided at the disc member for engagement with the first fastening member to secure the tee to the disc member at the desired elevation so that the golfer can hit the right part of the golf ball accurately to strike the golf ball long and straight.

According to another aspect of the present invention, the disc member has a wire hole for the insertion of a cord member, and a magnetic member adjustably mounted on the cord member for securing to a metal anchoring member, so that the tee and the disc member are kept near the metal anchoring member for a repeat use after the golfer hitting the golf ball.

According to one more aspect of the present invention, the tee has a multiple raised portions equiangularly spaced around a recess thereof for supporting a golf ball to prevent direct contact of the golf ball with the periphery of the recess so that less friction is produced between the golf ball and the tee to lower the rotation rate of the golf ball when the golf ball is driven away from the tee.

DETAILED DESCRIPTION OF THE INVENTION

Figure 1:
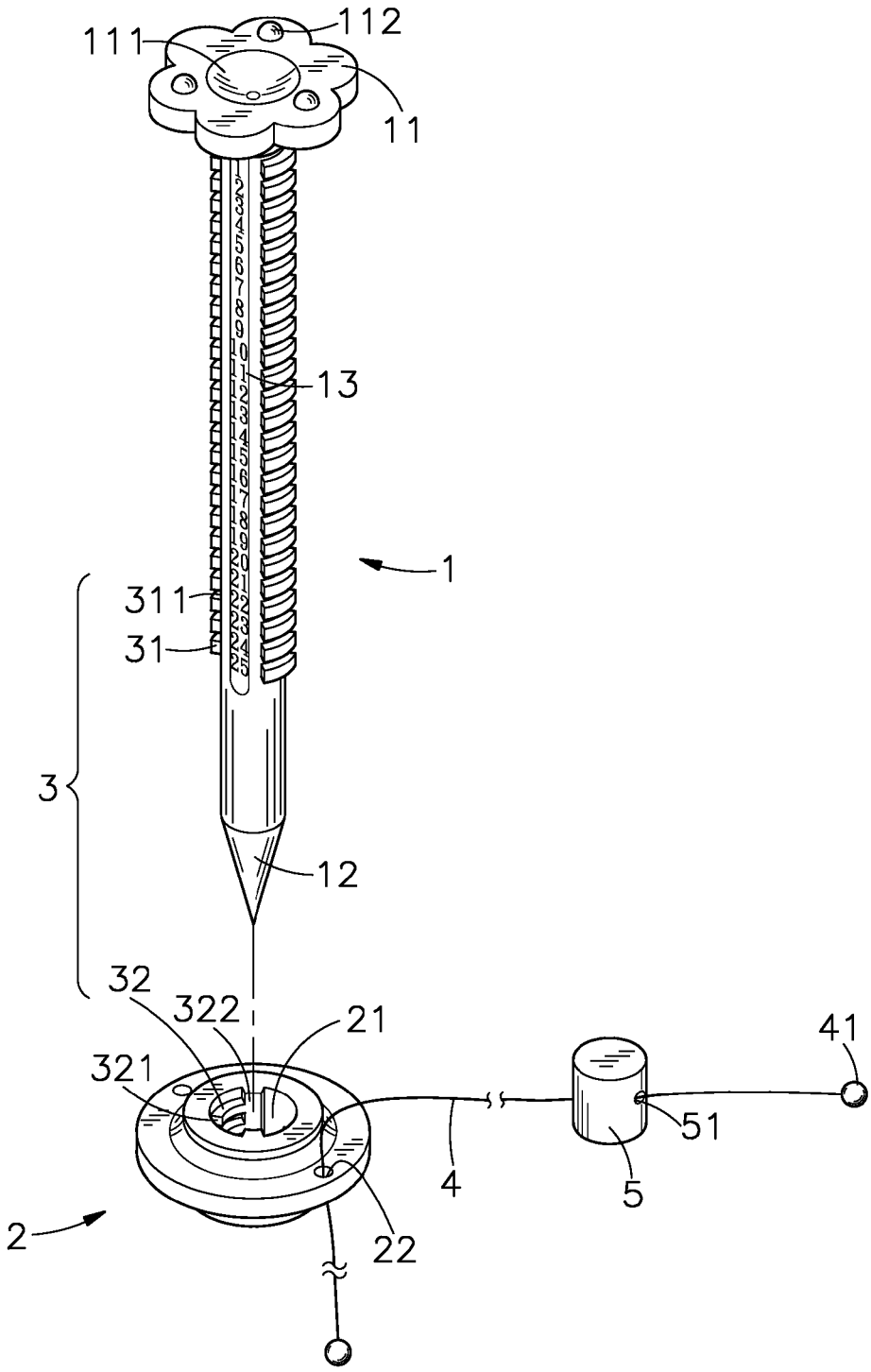
FIG. 1 is an exploded view of a golf tee set in accordance with a first embodiment of the present invention.

Referring to FIG. 1, a golf tee set in accordance with a first embodiment of the present invention is shown comprised of a tee 1, a disc member for adjusting the tee height 2, and fastening means 3.

The tee 1 has a head 11 at the top and a point 12 at the bottom thereof, and at least two different systems of length 13 (for example, the Metrics Units and the Imperial Units) marked on the tee body for measuring the height. The head 11 has a recess 111 formed on the top for receiving a golf ball, and multiple, for example, three raised portions 112 protruded from the top surface and equiangularly spaced around the recess 111 to support the golf ball in the recess 111. The head 11 has a specially designed contour so that a golfer can hold positively and rotate the head 11 with the hand.

The disc member 2 is adjustably mounted on the tee shaft of the tee 1, having a center hole 21 for the passing of the tee 1, at least one wire hole 22 for the insertion of a cord member 4. The cord member 4 is inserted through one wire hole 22 of the disc member 2 and a through hole 51 of a magnetic member 5, having two ends respectively securely mounted with a respective end piece 41 that has an outer diameter greater than the diameter of the wire holes 22 of the disc member 2 and the diameter of the through hole 51 of the magnetic member 5. Therefore, the end pieces 41 stop the disc member 2 and the magnetic member 5 from slipping out of the cord member 4.

Figure 2:
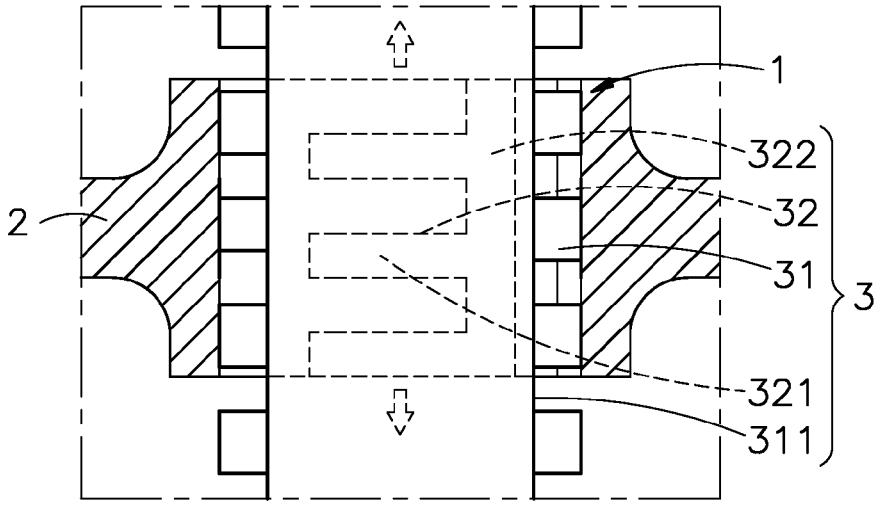
FIG. 2 is a schematic sectional view of a part of the golf tee set according to the first embodiment of the present invention, showing the tee inserted through the center hole of the disc member and the engagement ribs disengaged from the grooves.
Figure 3:
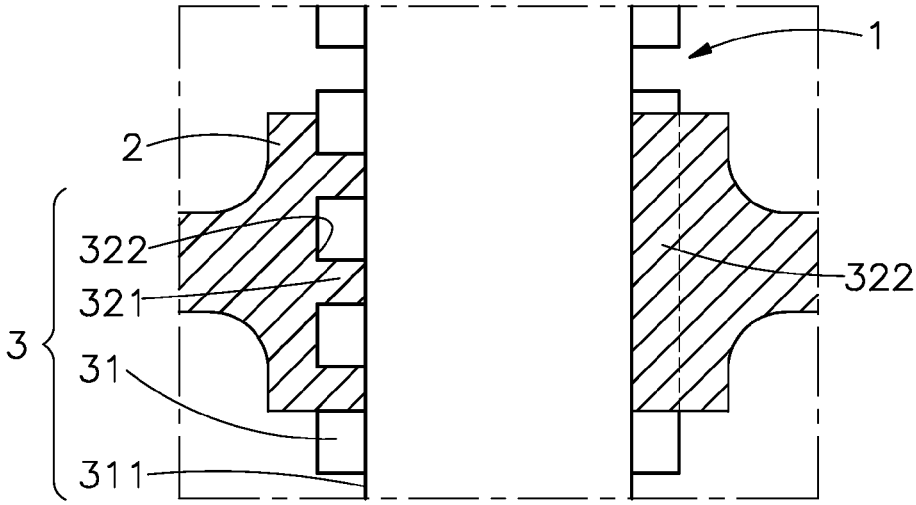
FIG. 3 is similar to FIG. 2 but showing the engagement ribs engaged with the grooves.

The fastening means 3 is adapted to secure the disc member 2 to the tee 1, consisting a first fastening member 31 formed on the periphery of the tee shaft of the tee 1, and a second fastening member 32 formed on the inside wall of the disc member 2 around the center hole 21 for engagement with the first fastening member 31. According to this embodiment, the first fastening member 31 consists of multiple grooves 311; the second fastening member 32 consists a protruding block 322 formed integral with the disc member 2 around the center hole 21, and multiple engagement ribs 321 protruding from one side of the protruding block 322 at different elevations for engaging the grooves 311 of the first fastening member 31. When in use, the golfer can insert the tee 1 through the center hole 21 of the disc member 2. When the grooves 331 of the first fastening member 31 and the protruding block 322 of the second fastening member 32 are disposed at two different vertical axes, the golfer can move the disc member 2 vertically along the tee 1 to the desired elevation (see FIG. 2). Further, the golfer can rotate the disc member 2 relative to the tee 1 90 degree horizontally to have the grooves 331 of the first fastening member 31 and the protruding block 322 of the second fastening member 32 be aligned at the same vertical axis and to interlocke the engagement ribs 321 into the grooves 311 of the first fastening member 31

Figure 4:
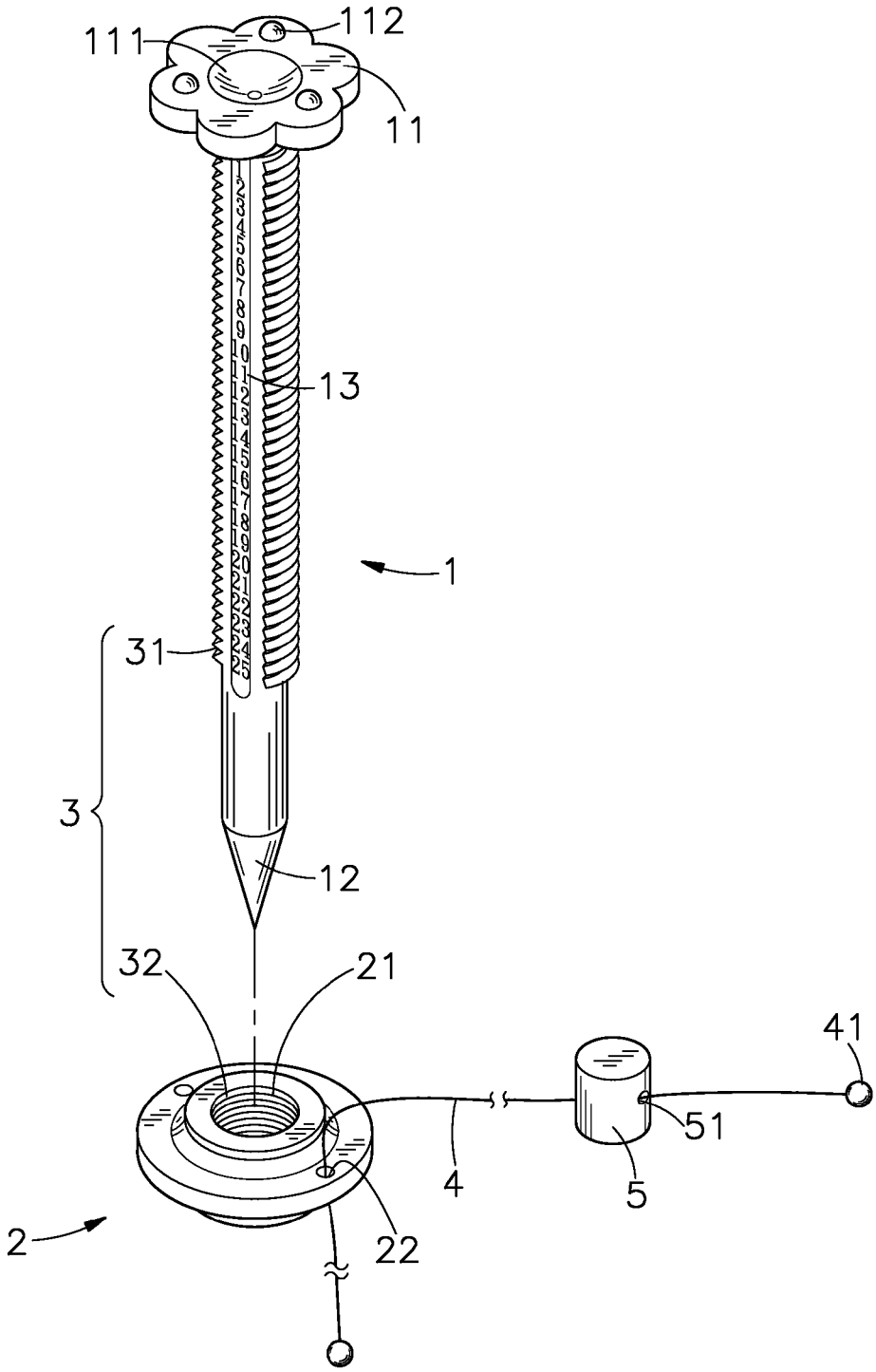
FIG. 4 is an exploded view of a golf tee set in accordance with a second embodiment of the present invention.

FIG. 4 shows a golf tee set in accordance with a second embodiment of the present invention. This embodiment is substantially similar to the aforesaid first embodiment with the exception of the design of the fastening means 3. According to this second embodiment, the first fastening member 31 is a male thread (or female thread) formed on the periphery of the tee body of the tee 1, and the second fastening member 32 is a female thread (or male thread) formed on the inside wall of the disc member 2 around the center hole 21 for engagement with the first fastening member 31.

Figure 5:
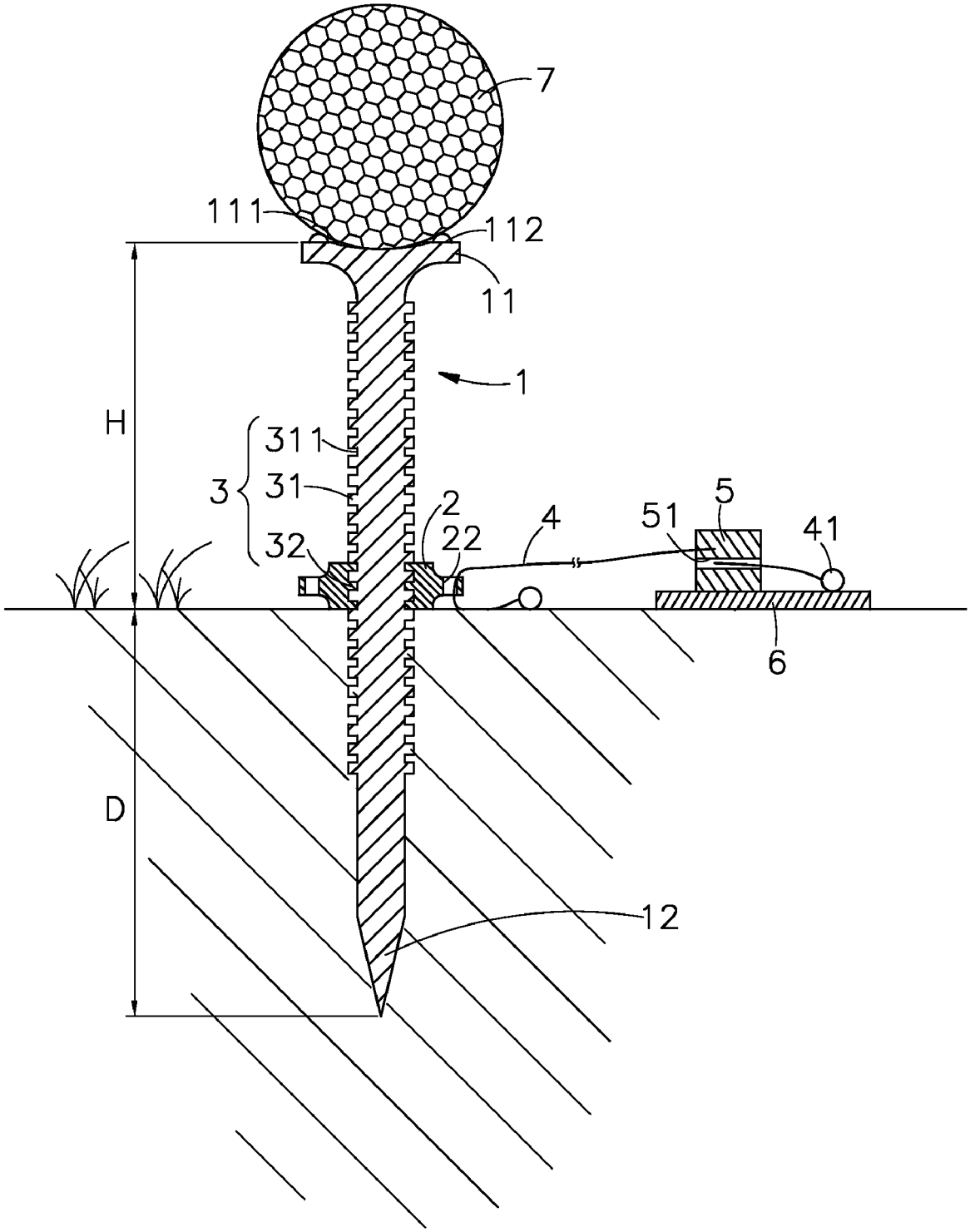
FIG. 5 is a schematic drawing showing an application example of the golf tee set according to the first embodiment of the present invention.
Figure 6:
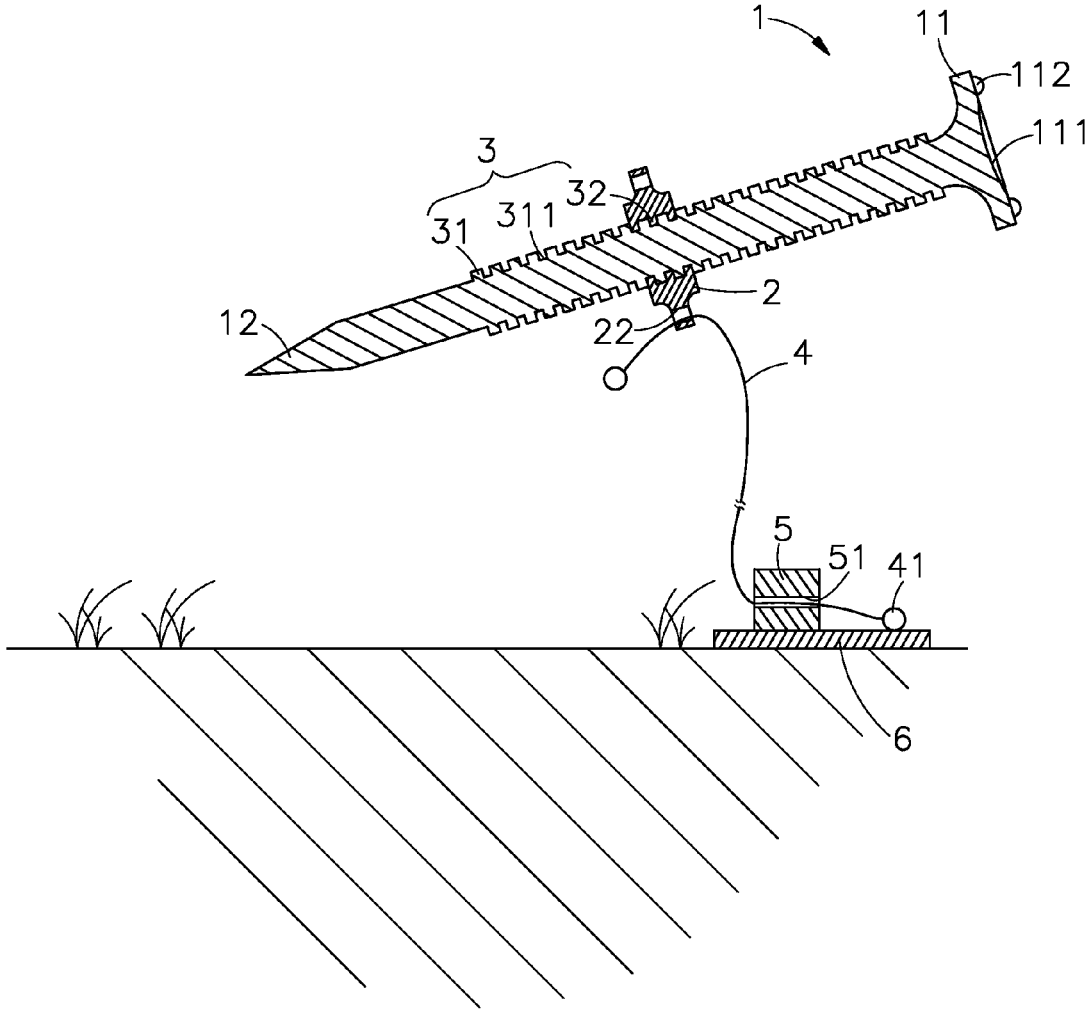
FIG. 6 is a schematic drawing showing a status of the golf tee set after use according to the first embodiment of the present invention.

Referring to FIGS. 5 and 6, when in use, the tee 1 is fastened to the ground, and the disc member 2 is stopped at the ground to limit an insertion depth D of the tee 1 at a preselected elevation H of the head 11 above the ground. By means of the disc member 2, the tee 1 is positively positioned in the ground at the desired elevation to support a golf ball 7 for striking so that the golfer can solidly hit the right part of the golf ball 7 to strike the golf ball 7 long and straight.

Further, a metal anchoring member 6 is placed on the ground to secure the magnetic member 5 by means of magnetic attraction so that the golfer aim the cord member 4 at the target hole (not shown) to guide the striking direction accordingly. Further, the metal anchoring member 6 can be a heavy iron plate or iron member that can be anchored to the ground. After the golfer hit the golf ball 7, the disc member 2 and the tee 1 is kept secured to the cord member 4 for a further use.

Further, the raised portions 112 support the golf ball 7 in the top recess 111 for hitting. Because the golf ball 7 is supported on the tee 1 at the raised portions 112 only and kept away from the periphery of the recess 111, less friction is produced between the golf ball 7 and the tee 1 therefore the golfer can strike the golf ball 7 longer.

Figure 7:
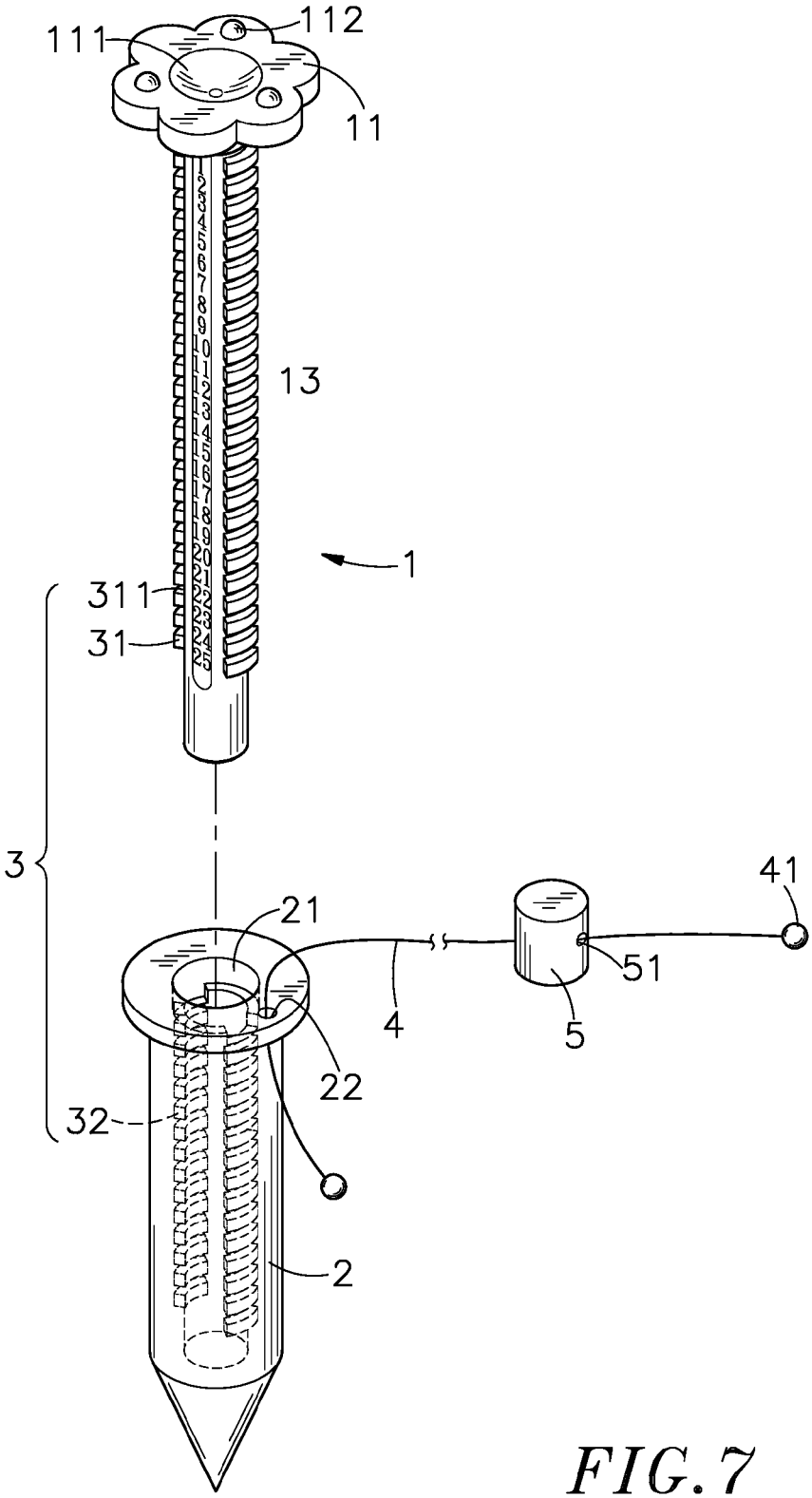
FIG. 7 is an exploded view of a golf tee set in accordance with a third embodiment of the present invention.
Figure 8:
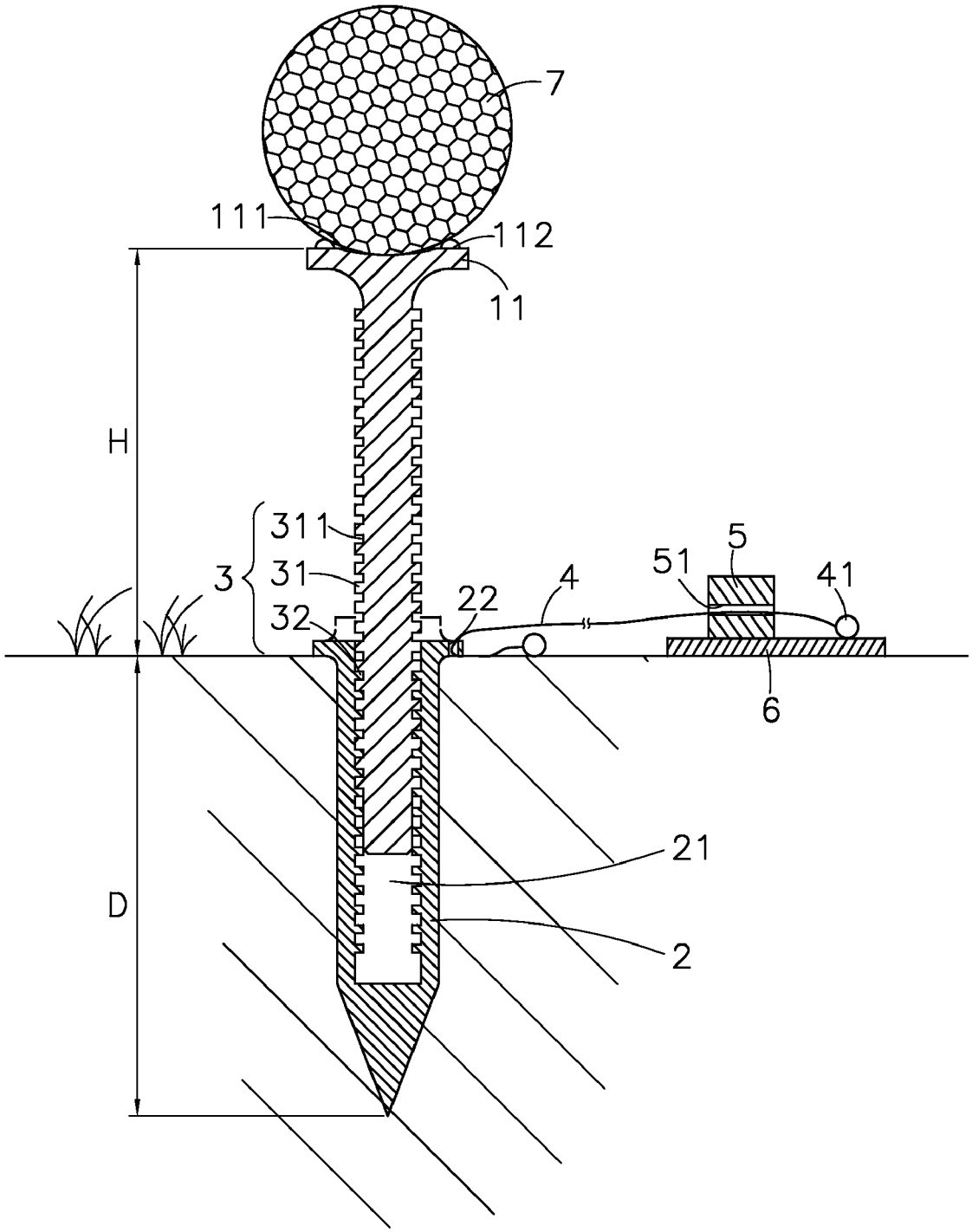
FIG. 8 is a schematic drawing showing an application example of the golf tee set according to the third embodiment of the present invention.

FIGS. 7 and 8 show a golf tee set in accordance with a third embodiment of the present invention and its application. Similar to the aforesaid first embodiment of the present invention, this third embodiment consists of a tee 1, a disc member 2 and fastening means 3. The tee 1 is similar to the tee in the aforesaid first embodiment. According to this third embodiment, the disc member 2 has a hollow shaft that can be directly anchored to the ground to support the tee 1 on the ground at the desired elevation. The disc member 2 has a center hole 21 axially extending to the top side for receiving the tee 1, and a wire hole 22 for the fastening of a cord member 4. The fastening means 3 consists of a first fastening member 31 formed with grooves 311 on the periphery of the tee shaft of the tee 1, and a second fastening member 32 with match grooves on the inside wall of the disc member 2 around the center hole 21 for engagement with the first fastening member 31 to hold the tee 1 in position. When installed, a insertion depth D of the disc member 2 in the ground and an adjustable height H of the head 11 of the tee 1 above the ground are controlled, i.e., a golf ball 7 is held at the desired elevation so that the golfer can hit the right part of the golf ball 7 accurately to strike the golf ball 7 long and straight.

Therefore, when this golf tee set is in use, it provides numerous benefits as follows:

1. The disc member 2 with the tee 1 mounted on top to support the tee 1 on the ground at the desired elevation so that the golfer can hit the right part of the golf ball 7 accurately and strike striking the golf ball 7 long and straight.

2. The disc member 2 is inserted with a cord member 4, which carries a magnetic member 5 for securing to a metal anchoring member 6. Therefore, the tee 1 and the disc member 2 are kept near the metal anchoring member 6 for a repetitive use.

3. The tee 1 has multiple raised portions 112 equiangularly spaced around the recess 111 for supporting a golf ball 7 to prevent direct contact of the golf ball 7 with the periphery of the recess 111 so that less friction is produced between the golf ball 7 and the tee 1 to reduce the energy loss of the golf ball 7 when the golf ball 7 is struck away from the tee 1, and therefore the user can strike the golf ball 7 straight and long.

4. The head 11 of the tee 1 has an specially designed contour so that the golfer can hold positively and rotate the tee 1 with the hand, preventing slipping of the hand from the tee 1 during rotation.

A prototype of golf tee set has been constructed with the features of FIGS. 1~8. The gold tee set functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A golf tee set comprising:

a tee, having a head at a top side of a tee shaft, a recess on said head, and multiple raised portions equiangularly spaced around said recess for supporting a golf ball for hitting;

a disc member for setting the tee on the ground at a desired elevation, said disc member having a center hole for the insertion of said tee, and at least one wire hole;

fastening means for fastening said tee to said disc member, said fastening means comprising a first fastening member formed integral with the tee shaft of the tee and a second fastening member formed integral with a part of the disc member around the center hole of the disc member for engagement with the first fastening member;

a cord member inserted through at least one wire hole of the disc member and secured to the disc member; and a magnetic member mounted on the cord member and movable between one end of the cord member and the disc member;

wherein said first fastening member is comprised of multiple grooves, and said second fastening member is comprised of multiple matching engagement ribs for engaging said grooves; and wherein the second fastening member comprises a protruding block formed integral with a part of the disc member inside the center hole; the engagement ribs are connected to the protruding block at one side at different elevations.

2. The golf tee set as stated in claim 1, wherein the first fastening member is a female thread, and the second fastening member is a male thread.

3. The golf tee set as stated in claim 1, wherein the disc member is a hollow nail.

4. The golf tee set as stated in claim 1 wherein the tee has two different systems of length marking for measuring distance.

5. The golf tee set as stated in claim 1, further comprising an anchoring member for fastening on the ground to secure the magnetic member by means of magnetic attraction.

6. The golf tee set as stated in claim 5, wherein the anchoring member is a heavy metal block member.

7. The golf tee set as stated in claim 5, wherein the anchoring member is a metal member insertable into the ground.

8. A golf tee set comprising:

a tee, having a head at a top side of a tee shaft, a recess on said head, and multiple raised portions equiangularly spaced around said recess for supporting a golf ball for hitting;

a disc member for setting the tee on the ground at a desired elevation, said disc member having a center hole for the insertion of said tee, and at least one wire hole;

fastening means for fastening said tee to said disc member, said fastening means comprising a first fastening member formed integral with the tee shaft of the tee and a second fastening member formed integral with a part of the disc member around the center hole of the disc member for engagement with the first fastening member;

a cord member inserted through at least one wire hole of the disc member and secured to the disc member; and a magnet mounted on the cord member and movable along the cord between one end of the cord member and the disc member.

9. The golf tee set according to claim 8, wherein said first fastening member is comprised of multiple grooves, and said second fastening member is comprised of multiple matching engagement ribs for engaging said grooves.

10. The golf tee set according to claim 9, wherein the second fastening member comprises a protruding block formed integral with a part of the disc member inside the center hole; the engagement ribs are connected to the protruding block at one side at different elevations.

11. The golf tee set as stated in claim 8, wherein the first fastening member is a female thread, and the second fastening member is a male thread.

12. The golf tee set as stated in claim 8, wherein the disc member is a hollow nail.

13. The golf tee set as stated in claim 8 wherein the tee has two different systems of length marking for measuring distance.

14. The golf tee set as stated in claim 8, further comprising an anchoring member for fastening on the ground to secure the magnet by means of magnetic attraction.

15. The golf tee set as stated in claim 14, wherein the anchoring member is a heavy metal block member.

16. The golf tee set as stated in claim 14, wherein the anchoring member is a metal member insertable into the ground.

* * * * *